US005913958A

United States Patent [19]

Balsells Ventura

[11] Patent Number: 5,913,958

[45] Date of Patent: Jun. 22, 1999

[54] MACHINE FOR LAYING OUT LAMINAR PRODUCTS

[76] Inventor: Angel Balsells Ventura, Ctra. Nacional II, km. 551.9, 08711, Odena, Spain

[21] Appl. No.: 08/774,267

[22] Filed: Dec. 27, 1996

[30] Foreign Application Priority Data

Dec. 28, 1995 [ES] Spain ..... 9502534

[51] Int. Cl.[6] ..... B26D 7/00; B23Q 15/00

[52] U.S. Cl. ..... 83/649; 83/72; 83/650

[58] Field of Search ..... 83/650, 649, 72

[56] References Cited

U.S. PATENT DOCUMENTS

| | | | |
|---|---|---|---|
| 4,186,633 | 2/1980 | Baumann et al. | 83/649 |
| 4,267,752 | 5/1981 | Byrt et al. | 83/650 |
| 4,809,573 | 3/1989 | Welch | 83/72 |
| 4,945,795 | 8/1990 | Tone | 83/650 |
| 5,441,374 | 8/1995 | Kosanke et al. | 83/650 |
| 5,553,522 | 9/1996 | Boldrini et al. | 83/650 |

*Primary Examiner*—M. Rachuba
*Assistant Examiner*—Sean Pryor
*Attorney, Agent, or Firm*—Steinberg & Raskin, P.C.

[57] ABSTRACT

Machine for laying out laminar products from a first bobbin on which a first laminar product is coiled and a second bobbin on which a second laminar product is coiled. The machine includes a device for unwinding the first laminar product from the first bobbin and a driving device for moving the first laminar product onto a table upon which it is laid out. A second device unwinds the second laminar product from the second bobbin and a control device is coupled to the unwinding devices to permit manual or automatic control of the laying out of the first and second laminar products on the table. The first laminar product is laid out together with the second laminar product, separately or simultaneously, in an automatic and controlled manner thereby avoiding the need for the operator to place the laminar products on the table by hand.

10 Claims, 2 Drawing Sheets

MACHINE FOR LAYING OUT LAMINAR PRODUCTS

The present invention relates to a machine for laying out laminar products from a bobbin on which a laminar product is coiled.

More specifically, the present invention relates to a machine for laying out one or several layers of fabric on a layer of paper.

BACKGROUND OF THE INVENTION

Known in the art are machines for laying out fabric from a bobbin of fabric which comprises feeding means for the coiled laminar product and driving means for the laminar product which facilitate emergence of same and drive it onto the table upon which it is laid out.

The aforesaid means are mounted on a movable carriage running the length of the table. As it moves, the carriage lays the bobbin out on the table until it reaches the end of same, where it is cut or a fold is formed as the direction of path of the carriage is inverted, which carriage then lays a second layer of fabric on the existing layer, and so forth.

The machine can thus lay out one or more layers of fabric along the table, as appropriate for each particular case of utilization.

There is frequently a need to lay out a dividing paper for each certain number of layers of fabric laid out, leaving on the work table in alternating manner and in vertical direction a certain number of groups of layers of fabric and layers of dividing paper.

The process followed for placing these layers of dividing paper has so far been carried out entirely manually, leaving the fabric laying out carriage stopped at one end of the table until the operator had placed and cut the pertinent layer of paper. Automatic laying out of the fabric with the carriage was then recommenced, until such time as another layer of paper was needed. This process was continued until the end of laying out, which involved a considerable loss of time in comparison with the time taken to lay out fabric in an automated manner.

DESCRIPTION OF THE INVENTION

The machine of the invention resolves the aforesaid drawbacks, while presenting further advantages which will be described below.

The machine of the invention for laying out laminar products is characterized in that is comprises a second bobbin upon which is coiled a second laminar product, means for driving said second bobbin, and controlling means which permit manual or automatic control of laying out of the two laminar products on the table in function of parameters such as the interval of laying out the second laminar product with respect to the first and the length of the layer of the second laminar product.

Thanks to this characteristic the first laminar product, the second laminar product or both at the same time, can be laid out in a totally automatic and controlled manner, thus avoiding the operator having to place the paper by hand.

Advantageously, the machine of the invention comprises means for cutting the laminar product or products.

According to one embodiment, the driving means for the second bobbin are motor-driven rollers.

According to a second embodiment, the driving means for the second bobbin are a motor-driven spindle coupled to the second bobbin.

According to a third embodiment, the driving means for the second bobbin are feed belts.

According to a fourth embodiment, the driving means for the second bobbin consist in a motor which drives the spindle of the bobbin by means of a transmission mechanism.

Advantageously, the machine of the invention comprises a driving cylinder which facilitates emergence of the laminar product from the second bobbin.

Preferably, the machine of the invention comprises a pressing cylinder which presses against the aforesaid driving cylinder, in such a way that the second laminar product is drawn between the two cylinders.

Advantageously, the machine of the invention comprises means for detecting the tension of the second laminar product.

Preferably, the machine of the invention comprises at least one plate upon which the laminar products slide.

Advantageously, the machine of the invention comprises means for detecting the position of the second laminar product.

Preferably, the means for detecting the position of the second laminar product are located at the beginning of the plate upon which the laminar products slide.

Also preferably, the means for detecting the position of the second laminar product comprise a photoelectric cell.

The second bobbin of laminar product can be arranged in different positions.

According to one embodiment, the second bobbin of laminar product is located above the line marking the path of the first laminar product from the first bobbin to the table, while according to another embodiment the second bobbin of laminar product is located beneath the line marking the path of the first laminar product from the first bobbin to the table.

Advantageously, the first sliding plate is articulated, in such a way that it can move to permit access to the second bobbin, thereby facilitating fitting and removal of the second bobbin onto and from the machine.

Preferably, the first laminar product is fabric and the second laminar product is paper.

BRIEF DESCRIPTION OF THE DRAWINGS

For a better understanding of all that has been set out some drawings are attached in which, schematically and solely by way of non-restrictive example, a practical case of embodiment is shown, in which drawings.

DESCRIPTION OF PREFERRED EMBODIMENTS

Figure 1:
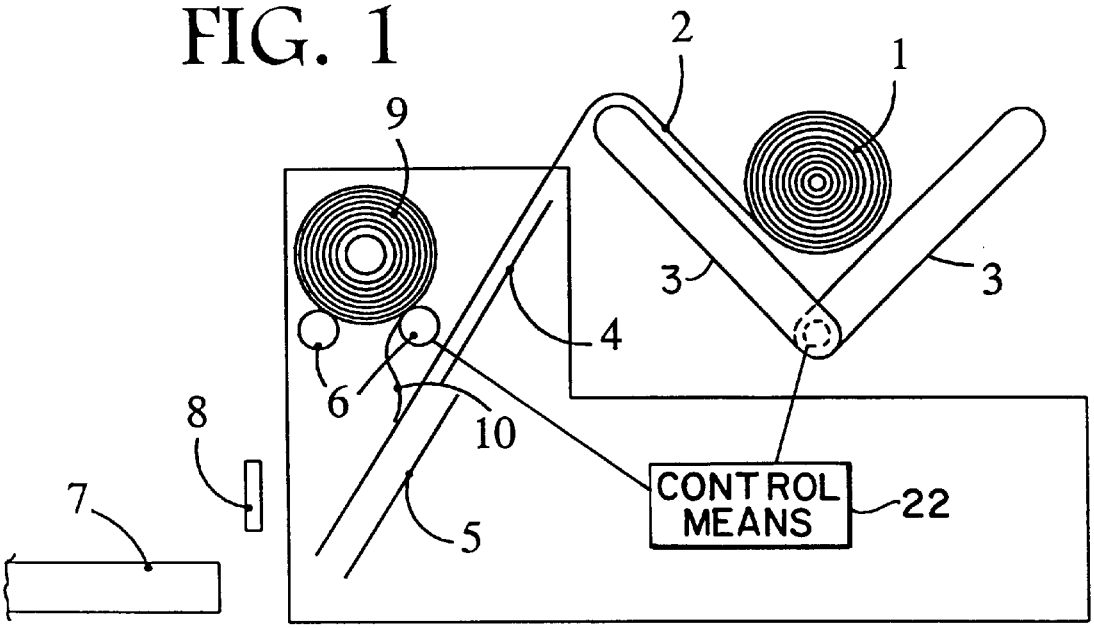
FIG. 1 is an elevation view of a first embodiment of the invention.

As can be seen in FIG. 1, the machine for laying out laminar products comprises a first bobbin 1 of fabric 2, which slides on first 4 and second 5 driving plates. On the second plate 5 paper 10 from a second bobbin 9 is placed on the fabric 2. The fabric 2 and paper 10 together are driven by means of the second plate 5 onto a table 7. Once the desired lengths of fabric 2 and paper 10 have been placed on the table, a cutting device 8 cuts the fabric 2 and paper 10 together.

In the embodiment shown in FIG. 1, the first bobbin is driven by means of a pair of belts 3, and the second bobbin is driven by means of a pair of motor-driven cylinders 6.

Figure 2:
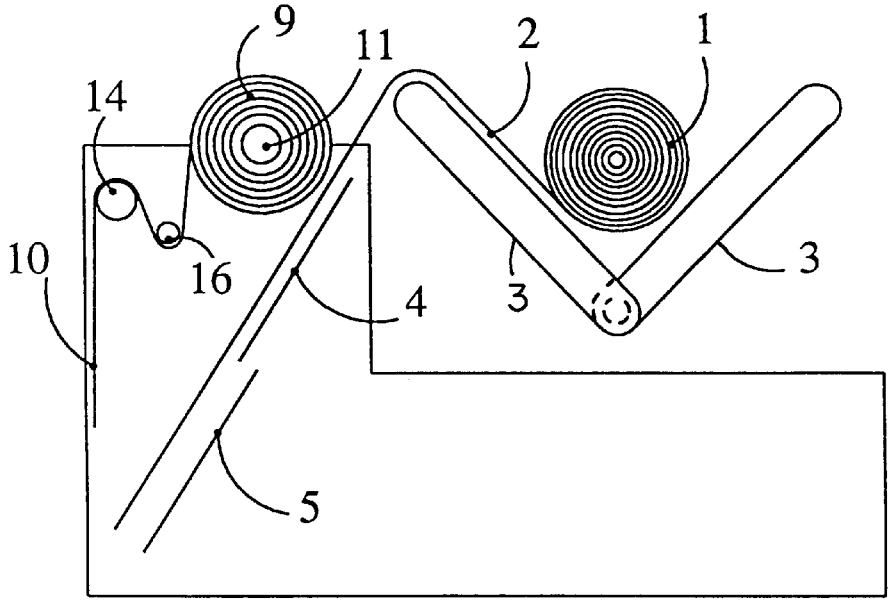
FIG. 2 is an elevation view of a second embodiment of the invention.

The operation of the embodiment shown in FIG. 2 is the same as that of the embodiment described for FIG. 1. In this case, at the outlet point of the second bobbin 9 the paper 10 passes along a driving cylinder 14 which facilitates its emergence and along a rocker arm 16 which controls the tension of the paper 10. This rocker arm 16 also comprises a sensor (not shown) which monitors the presence of paper 10.

In this second embodiment of the invention the second bobbin is driven by means of its own spindle 11, which is motor-driven and thus rotates.

Figure 3:
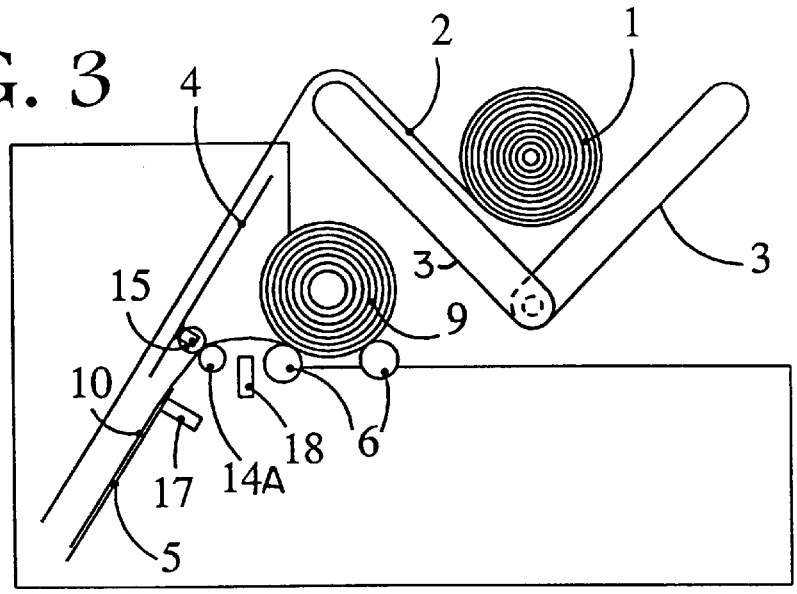
FIG. 3 is an elevation view of a third embodiment of the invention.

As described with respect to the embodiment shown in FIG. 2, the operation of a third embodiment, shown in FIG. 3, is also the same as that of the embodiment described in respect of FIG. 1. In this case, the second bobbin 9 of laminar product 10 is located beneath the line marking the path of the first laminar product 2 from the first bobbin 1 to the table 7.

Upon emergence from the second bobbin 9, the paper 10 passes along the driving cylinder 14A mentioned in describing the embodiment shown in FIG. 2. This cylinder 14A is pressed by a pressing cylinder 15, in such a way that the paper 10 is drawn between the two cylinders 14A, 15, with the pressing cylinder being fixed to the first driving plate 4.

At the beginning of the second driving plate 5 is placed a photoelectric cell 17 to detect the beginning of the paper 10, while at the output of the second bobbin 9 is located a sensor 18 which detects the tension of the paper 10.

Figure 4:
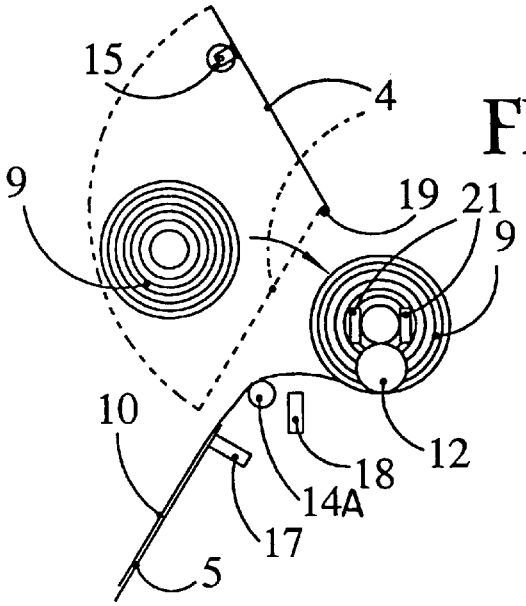
FIG. 4 is an elevation view showing how the bobbin of paper is changed, the driving means of the bobbin of paper being according to a fourth embodiment of the invention.

FIG. 4 shows how the second bobbin 9 is replaced in the event of it being located beneath the line marking the path of the first laminar product 2 from the first bobbin 1 to the table 7.

As can be seen in the figure, the first driving plate is articulated by means of a hinge 19, which permits the plate 4 to be lifted in order to allow access to the second bobbin 9.

Figure 5:
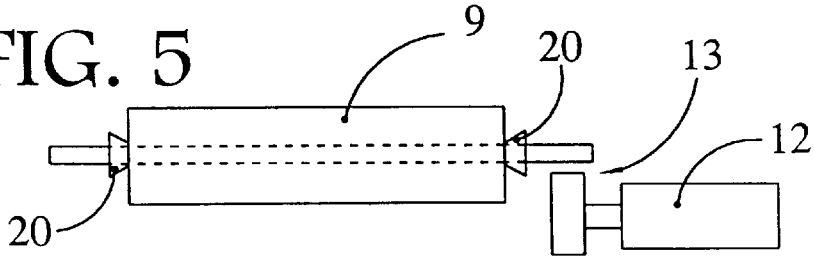
FIG. 5 is a front elevation view of the driving means for rotating either of the bobbins, according to the fourth embodiment of the invention.

The driving device of the second bobbin 9 shown in FIG. 4 is shown in front elevation view in FIG. 5. Rotation of the second bobbin 9 is driven by a motor 12 which means by means of a transmission 13 with the spindle of the second bobbin 9.

The second bobbin 9 comprises a pair of lateral cones 20 which secure the paper, while its spindle comprises some guides 21 (FIG. 4).

In the event of the second bobbin 9 needing to be guided laterally, the bobbin 9 can comprise a pair of lateral guide paddles (not shown).

The machine of the invention also comprises controlling means 22, which are connected to the driving means of the first and second bobbins 1,9, which permit the laying out of the two laminar products 2, 10 on the table 7 to be controlled in manual or automatic mode in function of parameters such as the intervals of layout of the second laminar product 10 with respect to the first 2 and the length of the layer of the second laminar product 10 and other suitable parameters.

It must be understood that the figures show four different driving systems for the bobbins 1, 9, which can be combined in any suitable way.

Although the figures show only one type of machine for laying out laminar products, it is obvious that the characteristics object of the present invention are applicable to any known machine for laying out laminar products.

It must also be understood that, although the embodiments shown have been described for applications in which the first laminar product is fabric and the second laminar product is paper, the machine of the invention can be applied for the laying out of any laminar product.

I claim:

1. Machine for laying out laminar products onto a table, comprising a first bobbin upon which a first laminar product is coiled, first driving means for unwinding the first laminar product from said first bobbin and moving the first laminar product onto the table to be laid out thereon, a second bobbin upon which a second laminar product is coiled, second driving means for unwinding the second laminar product from said second bobbin and moving the second laminar product onto the table to be laid out thereon, and control means coupled to said first and second driving means for controlling said first and second driving means, said control means being structured and arranged to operate said first and second driving means at the same time that the first and second laminar products are movable onto the table to be laid out thereon simultaneously.

2. The machine of claim 1, further comprising cutting means arranged between said first and second driving means and the table for cutting at least one of the first and second laminar products.

3. The machine of claim 1, wherein said second driving means comprise motor-driven rollers arranged in connection with said second bobbin.

4. The machine of claim 1, wherein said second driving means comprise a pair of motor-driven rollers arranged in contact with said second bobbin.

5. The machine of claim 1, wherein said first driving means comprise movable feed belts.

6. The machine of claim 1, wherein said first driving means comprise a pair of movable feed belts defining a V-shaped channel in which said first bobbin is arranged.

7. The machine of claim 1, further comprising at least one plate arranged between said first bobbin and the table and such that the first laminar product slides on said at least one plate.

8. The machine of claim 1, further comprising a first plate arranged between said first bobbin and the table and such that the first laminar product slides on said first plate, and a second plate arranged after said first plate in a running direction of the first laminar product, between said second bobbin and the table and such that the first laminar product slides on said second plate.

9. The machine of claim 1, wherein said second bobbin is arranged above a line marking a path of the first laminar product from said first bobbin to the table.

10. In an apparatus for laying out a first laminar product from a first bobbin onto a table and a second laminar product from a second bobbin onto the table, the improvement comprising:

first driving means for unwinding the first laminar product from the first bobbin and move the first laminar product onto the table to be laid out thereon, second driving means for unwinding the second laminar product from the second bobbin and move the second laminar product onto the table to be laid out thereon, and control means coupled to said first and second driving means for controlling said first and second driving means to enable said first and second driving means to operate simultaneously such that the first and second laminar products are moved onto the table to be laid out thereon simultaneously.

* * * * *